United States Patent [19]

Schantz

[11] Patent Number: 4,576,574

[45] Date of Patent: Mar. 18, 1986

[54] GAS HORSESHOE FORGE

[76] Inventor: Robert E. Schantz, 1226 Mead Dr., St. Louis, Mo. 63137

[21] Appl. No.: 694,785

[22] Filed: Jan. 25, 1985

[51] Int. Cl.[4] ..... F24J 3/00; F27D 1/00; F23D 14/62; F23M 7/00

[52] U.S. Cl. ..... 432/120; 110/173 R; 110/195; 126/194; 126/226; 431/354; 432/231; 432/247; 432/250

[58] Field of Search ..... 432/120, 224, 231, 247, 432/159, 250; 431/354; 110/173 R, 195; 126/226, 194

[56] References Cited

U.S. PATENT DOCUMENTS

| | | | |
|---|---|---|---|
| 1,305,034 | 5/1919 | Tripp et al. | 432/159 |
| 1,904,427 | 4/1933 | Elze | 432/159 |
| 1,944,061 | 1/1934 | Beverly | 126/194 |
| 3,501,098 | 3/1970 | Evans | 431/354 |
| 3,752,643 | 8/1973 | Robinson | 432/120 |
| 3,838,538 | 10/1974 | Burford | 126/194 |
| 3,960,093 | 1/1976 | Gregory | 110/195 |
| 4,115,051 | 9/1978 | Bjerklie | 110/173 R |
| 4,424,025 | 1/1984 | Jones | 432/120 |
| 4,451,230 | 5/1984 | Bocci et al. | 431/354 |

*Primary Examiner*—John J. Camby
*Attorney, Agent, or Firm*—Glenn K. Robbins

[57] ABSTRACT

A portable gas forge. The forge is comprised of a housing having an insulated interior and an opening for insertion of the article to be heated such as a horseshoe or the like. The forge is resistant to blow-out by wind when used in the field and has a specially designed burner connected to the top of the housing. The burner is connected to a source of gas such as an LP gas cylinder. A gas orifice is connected to an enlarged burner pipe having a bell-shaped primary air inlet adjacent the gas orifice. A source of secondary air is located at the exterior pipe connection to the housing to provide an annular air passage through the housing to the burner outlet to obtain maximum flame concentration in the housing and inhibit burn back or back flaming. An internal restrictor adjacent the burner pipe outlet is employed to increase the burner gas velocity and aid in secondary air aspiration and combustion efficiency. A door is hinged at the bottom of the housing and may be opened to a horizontal position to provide a shelf support for the article to be heated.

11 Claims, 5 Drawing Figures

GAS HORSESHOE FORGE

RELATED APPLICATION

This application is co-pending with application Ser. No. 596,259, filed Apr. 3, 1984 now U.S. Pat. No. 4,545,361, of which I am a co-inventor.

BACKGROUND OF THE INVENTION

In the past various types of portable gas forges have been employed in the field. One such important use has been that of the farrier or horseshoer for working and forming horseshoes. In the field use access to electrical or other source of power is limited and a simply operated gas forge is highly desirable for maximum efficiency at a low cost.

While such portable gas forges have been available, they have been subject to burn-out or flame-out where sudden gusts of wind extinguish the flame and reguire reignition with the consequent disadvantage of downtime and interruption of the operation. In addition backburning within the burner can occur at low pressure which adversely affects forge efficiency. When working with horses such interruption can be especially troublesome where the horses are of a nervous disposition. Flame-out can be caused unexpectedly in gas forges in which the burner outlet is spaced from the housing burner opening to provide for combustion air introduction. Such burners, while efficient in the absence of wind currents are troublesome in the field and also require operation at substantial gas pressures which detracts from an economic operation.

SUMMARY OF THE INVENTION

By means of this invention there has been provided a portable gas forge which can be operated in the field in windy conditions economically with efficient combustion and at relatively low gas pressure and low cost.

The forge is comprised of a housing having an insulated liner and a shelf for supporting articles to be heated such as horseshoes or the like. An opening in the housing provides access for insertion and removal of the horseshoes. A door is provided to preserve heat in a closed position and to serve as a horizontal shelf support for horseshoes in an open position. While the forge is particularly described in connection with the working of horseshoes, it will be understood that other metallic articles may be employed which are to be heated and brought up to forge working temperatures of 1400°–1800° F. or as high as welding temperatures of the order of 2200° F.

A specially designed burner is employed which uses a standard gas supply such as a cylinder of LP gas. Through the use of this burner protection from effects of wind is obtained together with the advantage of operating at a low gas pressure of 5 to 10 pounds per square inch for a working forge temperature and 12 to 15 pounds per square inch for welding temperatures. This is to be contrasted with the considerably higher pressures of about 25 pounds per square inch for working temperatures and 40 pounds per square inch for welding temperature in prior forges employing a burner spaced from the housing.

The burner of this invention comprises a burner pipe or conduit which extends from a source of LP gas directly to the top of the forge housing to direct a high temperature flame into the housing to heat the horseshoe or other article. A resticted small diameter gas orifice opens into the center of the enlarged pipe and is surrounded by an enlarged primary air inlet.

The enlarged primary inlet is in the form of a bell-shaped air inlet into which the gas orifice is centered. Primary air is drawn into the burner pipe by a venturi suction to create a combustible gas mixture which is ignited to form the gas high temperature flame inside the forge.

Secondary air is introduced at the burner pipe outlet adjacent a junction of the pipe with the housing. Circumferential ports around the exterior of the pipe and an annular opening in the housing provide a passage for even introduction of secondary air into the combustible air-gas mixture to inhibit flaming or burning of the gas inside the burner pipe before it is introduced into the forge. The secondary air is contacted by the hot refractory and burner outlet end and is preheated to aid in combustion efficiency. A reduced internal diameter of the burner pipe at the outlet acts as a restrictor to increase velocity and promote mixing of gas and air at the outlet of the burner pipe within the forge.

The portable forge of this invention is simply operated in the field to provide a wind and weather resistant gas forge which can be rapidly brought up to temperature. It is rugged in construction and may be employed at a high degree of efficiency and at relatively low cost.

The above features are objects of this invention. Further objects will appear in the detailed description which follows and will be further apparent to those skilled in the art.

For the purpose of illustration of this invention, preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
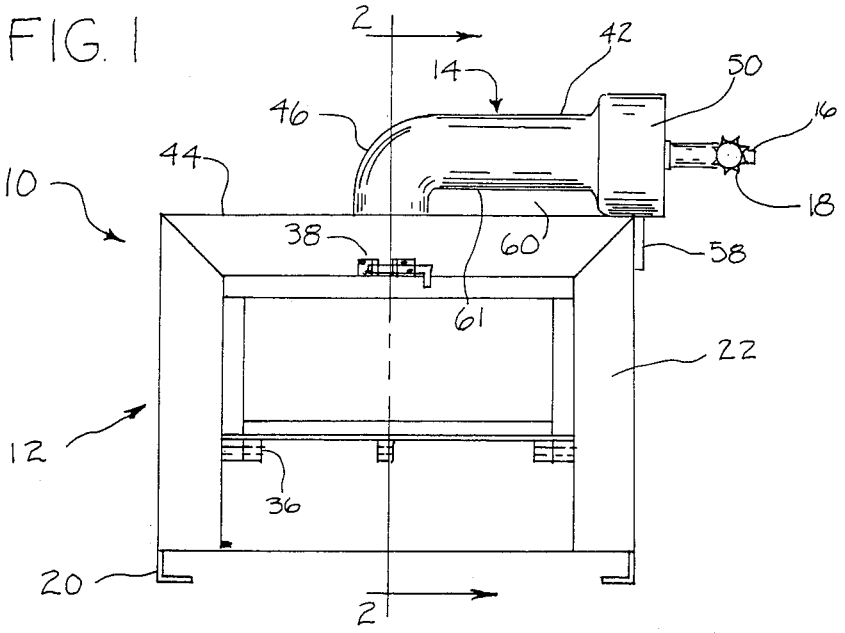
FIG. 1 is a view of the forge in front elevation with the door closed.
Figure 2:
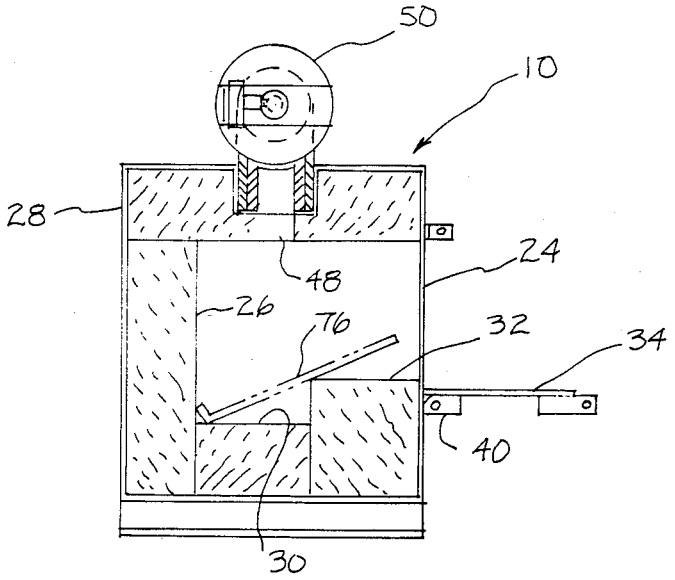
FIG. 2 is a view in section taken on the line 2—2 of FIG. 1 with the door opened in the shelf position.
Figure 3:
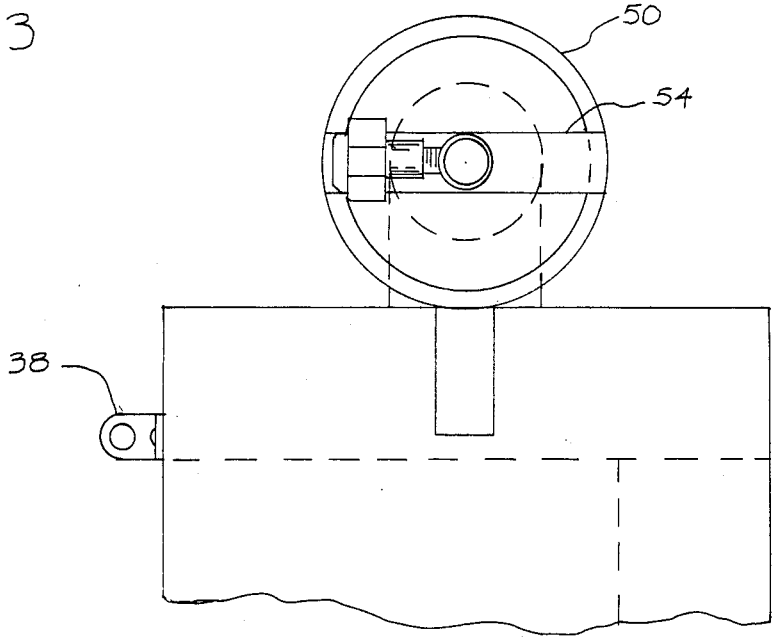
FIG. 3 is a fragmentary view elevation taken from the right side of FIG. 1.
Figure 4:
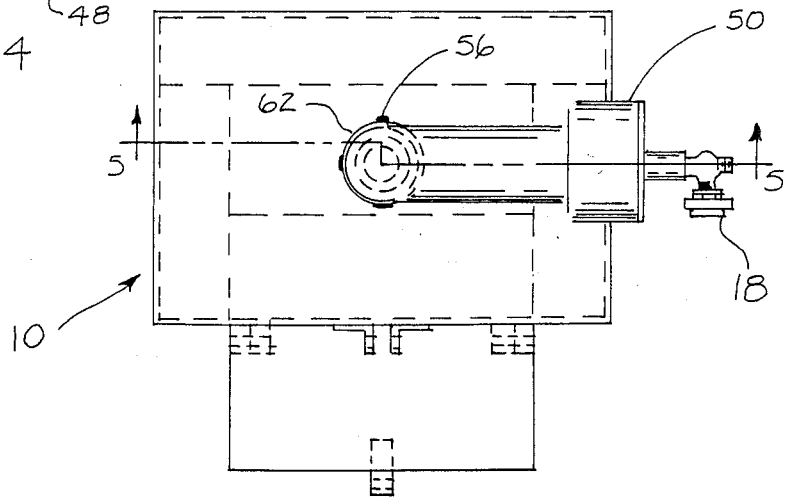
FIG. 4 is a top plan view showing the door open.

The gas forge of this invention is generally indicated by the reference numeral 10 in FIGS. 1, 2 and 4. It is comprised of a housing 12, a burner 14 and a gas line 16 and valve 18. The gas line is connected to a conventional LP gas tank (not shown).

The housing is supported on legs 20 and has a front wall 22 provided with an opening 24. An insulated interior lining 26 is used for heat retention and insulation and is covered by an exterior protective shell 28 which is of metal. The interior of the housing has a bottom wall 30 bounded by a shelf or ledge 32. This configuration enables an article to be supported in a tilted position as shown in FIG. 2.

A door 34 is provided with hinges 36 at a lower portion of the housing opening to conserve heat. It has a top latch 38 for closure and when opened is supported in a horizontally extending shelf support position whereby horseshoes may be supported while being worked. A square shoulder 40 of the hinge acts as a stop against the housing to support the door horizontally.

Figure 5:
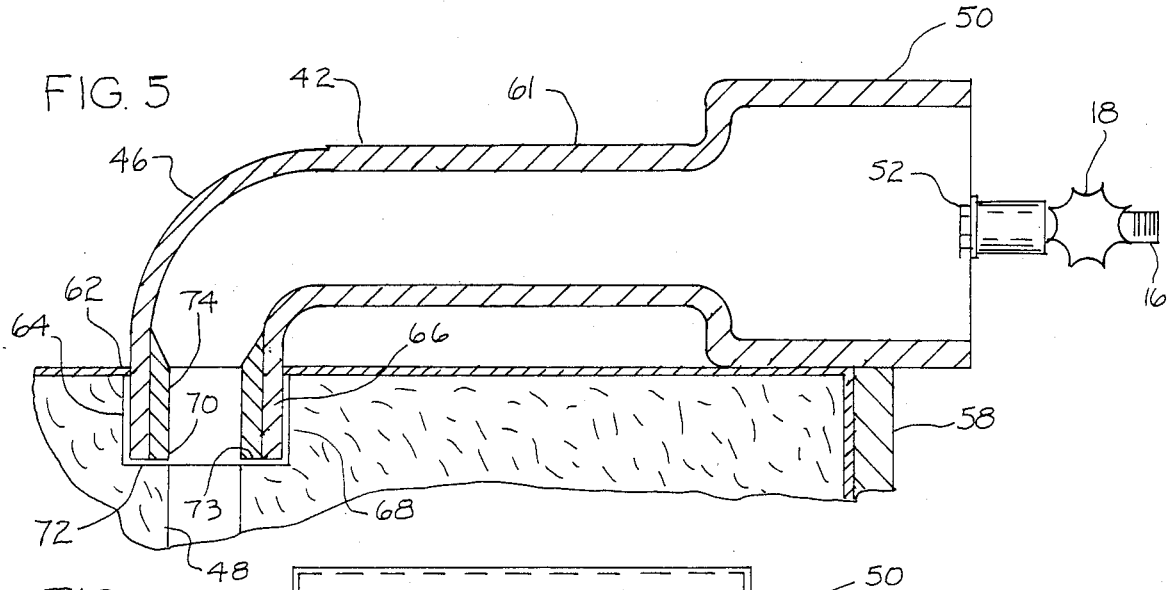
FIG. 5 is an enlarged fragmentary view in section taken on line 5—5 of FIG. 4.

The burner construction is best shown in FIGS. 1 and 5. It is comprised of a main body 42 supported above a top wall 44 of the housing. The body has a forward elbow portion 46 extending into an opening 48 in the housing top wall to direct the burner flame into the interior of the housing.

A rear portion of the burner housing is provided with an enlarged bell-shaped primary air inlet 50. This air inlet has an internal diameter substantially greater than that of the main body of the burner to permit the introduction of air by aspiration into the interior of the main body of the burner.

The bell-shaped primary air inlet further serves to support a small diameter gas orifice 52 within the center of the air inlet. The orifice is connected to the gas line and is supported by a cross brace member 54 upon the primary air inlet.

The burner is connected to the top of the metal housing shell 28 at the elbow by weldments 56. Additional weldments are provided on a brace 58 connecting the bell-shaped primary inlet 50 to the side of the housing shell. These connections provide a strong burner structure with a space 60 underneath the horizontal portion of the burner which may receive a part of the user's hand. The burner may be used as a handle by grasping the main body handle portion 61 in rugged use without damage.

Secondary air as best shown in FIGS. 4 and 5 is provided to the burner by air ports 62 between the weldments leading to an annular air chamber 64 extending between the weldments and around the exterior of the bottom of the burner pipe 66 and an interior opening 68 in the insulation which has a slightly larger diameter than the outside diameter of the burner. The bottom of the burner pipe has an outlet 70 which sits on a shoulder 72 of the insulation leading to the reduced diameter bottom opening 48. The shoulder 72 provides a means for properly spacing the burner within the insulation while still providing an air passage through the housing to the burner outlet. The bottom of the burner outlet may be scalloped or roughened to provide air passages 73 in order that a loose seat is established such that secondary air may pass through the annular opening past the shoulder to the interior of the housing adjacent the burner outlet. Conversely the shoulder may be scalloped or roughened.

In order to increase velocity and aspirate or draw in secondary air more efficiently a restrictor element 74 is employed in the burner outlet 70. The restrictor provides a reduced internal diameter to increase velocity which aids in aspiration of the secondary air and promotes combustion efficiency and mixing with the secondary air at low gas pressure and inhibits burn-back within the burner.

OPERATION

The portable gas forge of this invention is very easily used in the field. It is transported with a small cylinder of LP gas and may be simply carried by the main body handle 61 and transported in a car or truck to the desired location.

For ignition, the valve 18 is opened and a lighted taper is inserted into the interior of the housing to ignite the burner. No bellows or forced air of any type is required.

The bell-shaped primary air inlet introduces air by aspiration created by the ejection of gas under pressure through the orifice 52. The combustible mixture so produced flows through the main body of the burner through the burner outlet 70 and the housing outlet 48 into the interior of the forge housing.

Secondary air is introduced through the secondary air ports 62 to the annular passage 64 past the shoulder 72 to the burner outlet 70. In this passage the secondary air contacts the hot sides of the burner and the refractory and is preheated to aid in combustion efficiency. This secondary air inhibits burn back or burning inside the main body of the burner to ensure that the flame is emitted from the burner to the interior of the housing. The restrictor 74 acts to increase the velocity of the air-gas mix within the burner at the burner outlet and in so doing effectively draws in or aspirates secondary air to the burner outlet.

After the burner flame has been established, the article to be heated such as the horseshoe 76 shown in FIG. 2 is grasped by a pair of tongs and inserted through the forge opening 24 and rested against the ledge. When heated to the proper heat, it is removed for working.

The temperature within the forge is adjusted by the conventional pressure regulator on the gas cylinder (not shown) as in conventional practice. Generally working forge temperatures within the range of 1400°-1800° F. are obtained at 5 to 10 pounds per square inch gas pressure while higher welding or fusion temepratures of the order of 2200° F. are obtained at 12 to 15 pounds per square inch pressure. The forge may also be operated at pressures as low as 1.5 pounds per square inch without burn back and consequent problems which has not been found possible with other types of horseshoe forges. When the horseshoe has been brought up to the cherry red heat for working forging temperature or white hot heat for welding temperature it is removed and worked as required.

The door 34 aids in conserving heat within the forge when heat loss is a problem. Further it ma advantageously be used as a shelf in the horizontal open position to support horseshoes for inspection, cooling or the like.

The forge of this invention may be simply moved by lifting on the burner handle in or out of line with the prevailing wind or weather as required. Ambient air is all that is necessary for the primary and secondary air and bellows or forced air is not employed. It may be employed in the field in adverse weather conditions in a simple and efficient manner and due to its rugged handle construction will withstand the considerable wear, tear and handling abuse accompanying employment in the field.

Various changes and modifications may be made within this invention as will be apparent to those skilled in the art. Such changes and modifications are within the scope and teaching of this invention as defined in the claims appended hereto.

What is claimed is:

1. In a gas forge comprised of box-like housing having an insulated interior lining and an opening in a front wall for insertion of an article to be heated, the improvement comprising a wind-resistant low pressure burner having a burner outlet opening in a top wall of the housing, said burner having an imperforate tubular main body extending from a connection in said top wall rearwardly to a gas source of supply, said gas source of supply being connected to a restricted orifice supported in an enlarged annular rear primary air opening at a rear portion of the burner main body and said burner having a secondary air opening communicating with ambient air exteriorly of said housing, said burner outlet extending through an opening in said top wall of said housing and said secondary air opening comprising an annular opening between said top wall and said burner main body extending through said top wall to said outlet, said burner body being connected by a circumferential weldment means to a protective metallic shell enclosing said interior lining and said secondary opening being comprised of an opening means between said weldment means and said metallic shell and said burner body.

2. In a gas forge comprised of a box-like housing having a insulated interior lining and an opening in a front wall for insertion of an article to be heated, the improvement comprising a wind-resistant low pressure burner having a burner outlet opening in a top wall of the housing, said burner having an imperforate tubular main body extending from a connection in said top wall rearwardly to a gas source of supply, said gas source of supply being connected to a restricted orifice supported in an enlarged annular rear primary air opening at a rear portion of the burner main body and said burner having a secondary air opening communicating with ambient air exteriorly of said housing, said burner outlet extending through an opening in said top wall of said housing and said secondary air opening comprising an annular opening between said top wall and said burner main body and extending through said top wall to said outlet, the opening in the top wall of the housing extending through said insulated lining to the interior of said housing, said opening comprising an enlarged upper portion connected to a reduced lower portion by a shoulder supporting said burner outlet.

3. The gas forge of claim 2 in which said burner body is connected by a circumferential weldment means to a protective metallic shell enclosing said interior lining and said secondary opening is comprised of an opening means between said weldment means and said metallic shell and said burner body and extending past said shoulder in communication with said burner outlet.

4. The gas forge of claim 2 in which the burner outlet is closely received within said enlarged upper portion of the opening in the top wall of the housing and the burner outlet has an outlet opening substantially congruent with the reduced lower portion of the top wall in the housing.

5. In a gas forge comprised of a box-like housing having an insulated interior lining and an opening in a front wall for insertion of an article to be heated, the improvement comprising a wind-resistant low pressure burner having a burner outlet opening in a top wall of the housing, said burner having an imperforate tubular main body extending from a connection in said top wall rearwardly to a gas source of supply, said gas source of supply being connected to a restricted orifice supported in a enlarged annular rear primary air opening at a rear portion of the burner main body and said burner having a secondary air opening communicating with ambient air exteriorly of said housing, said burner outlet extending through an opening in said top wall of said housing and said secondary air opening comprising an annular opening between said top wall and said burner main body and extending through said top wall to said outlet, said main body having an internal restricting means adjacent said outlet serving as an aspirator to increase the velocity of gas within the burner and draw secondary air into the gas at the burner outlet.

6. The gas forge of claim 5 in which means ar provided for preheating said secondary air, said means comprising secondary air passage means extending from the exterior of said housing in heat exchange relation with said main burner body through the top wall of the housing contiguous with said burner outlet and said main body has an internal restricting means adjacent said outlet serving as an aspirator to increase the velocity of gas within the burner and draw secondary air into the gas at the burner outlet.

7. In a gas forge comprised of a box-like housing having an insulated interior lining an opening in a front wall for insertion of an article to be heated, the improvement comprising a wind-resistant low pressure burner having a burner outlet opening in a top wall of the housing, said burner having an imperforate tubular main body extending from a connection in said top wall rearwardly to a gas source of supply, said gas source of supply being connected to a restricted orifice supported in an enlarged annular rear primary air opening at a rear portion of the burner main bodCy and said burner having a secondary air opening communicating with ambient air exteriorly of said housing, said burner outlet extending through an opening in said top wall of said housing and said secondary air opening comprising an annular opening between said top wall and said burner main body and extending through said top wall to said outlet, said housing being provided with a protective metallic shell exteriorly of said insulated lining and said main body being comprised of a horizontal tubular handle section spaced above the top wall of the metallic shell a sufficient distance to provide a hand space to receive a portion of a individual's hand and means rigidly connecting said handle section to said metallic shell forwardly and rearwardly of said handle section.

8. The gas forge of claim 7 in which said burner body includes an elbow extending from said burner outlet to said handle section, and said means rigidly connecting said handle section to the metallic shell comprising a first weldment means connecting said elbow to said top wall of the metallic shell and second weldment means connecting the rear portion of the burner body to said metallic shell, said first weldment means and said second weldment means being sufficiently spaced from each other to leave said hand space unrestricted by said weldment connecting means.

9. The gas forge of claim 7 in which a door is provided for closing said opening, hinge means connecting said door to said housing for movement of said door from a vertical opening closing position to an open horizontal position, said hinge means being positioned adjacent a bottom portion of said door and rest means supporting said door in the open position horizontally with respect to said housing as a shelf to support the article to be heated.

10. In a gas forge comprised of a box-like housing having an insulated interior lining and an opening in a front wall for insertion of an article to be heated, the improvement comprising a wind-resistant low pressure burner having a burner outlet opening in a top wall of the housing and extending into the interior of the top wall, said burner having an imperforate tubular main body extending from a connection in said top wall rearwardly to a gas source of supply, said gas source of supply being connected to a restricted orifice supported in an enlarged annular rear primary air opening at a rear portion of the burner main body and said burner having a secondary air opening communicaitng with ambient air exteriorly of said housing, said burner outlet extending through an opening in said top wall of said housing and terminating in the interior thickness of said insulated interior lining and said secondary air opening comprising an annular opening between said top wall and said burner main body and extending through said top wall to said outlet, said burner body having connecting means connecting it to a protective metallic shell enclosing said interior lining, said connecting means being rigidly connected to said burner body and said metallic shell and extending across said annular opening.

11. The gas forge of claim 10 in which said main body is comprised of a horizontal tubular handle section spaced above the top wall of the metallic shell a sufficient distance to provide a hand space to receive a portion of an individual's hand and said connecting means rigidly connecting said handle section to said metallic shell forwardly of said handle section.

* * * * *